US006027631A

United States Patent [19]

Broadbent

[11] Patent Number: 6,027,631

[45] Date of Patent: Feb. 22, 2000

[54] ELECTROPLATING SYSTEM WITH SHIELDS FOR VARYING THICKNESS PROFILE OF DEPOSITED LAYER

[75] Inventor: Eliot K. Broadbent, Beaverton, Wash.

[73] Assignee: Novellus Systems, Inc., San Jose, Calif.

[21] Appl. No.: 08/968,814

[22] Filed: Nov. 13, 1997

[51] Int. Cl.[7] ..... C25D 5/00

[52] U.S. Cl. ..... 205/137; 204/212; 204/DIG. 7

[58] Field of Search ..... 205/136, 135, 205/137, 157, 96; 204/224 R, 212, DIG. 7

[56] References Cited

U.S. PATENT DOCUMENTS

| | | | |
|---|---|---|---|
| 3,962,047 | 6/1976 | Wagner | 204/15 |
| 4,137,867 | 2/1979 | Aigo | 118/627 |
| 4,246,088 | 1/1981 | Murphy et al. | 204/181 |
| 4,259,166 | 3/1981 | Whitehurst | 204/279 |
| 4,280,882 | 7/1981 | Hovey | 204/15 |
| 4,304,641 | 12/1981 | Grandia et al. | 204/23 |
| 4,339,297 | 7/1982 | Aigo | 156/345 |
| 4,339,319 | 7/1982 | Aigo | 204/224 |
| 4,341,613 | 7/1982 | Prusak et al. | 204/281 |
| 4,469,566 | 9/1984 | Wray | 204/23 |
| 4,534,832 | 8/1985 | Doiron, Jr. | 204/15 |
| 4,565,607 | 1/1986 | Hanak et al. | 204/38.1 |
| 4,597,836 | 7/1986 | Schaer et al. | 204/4 |
| 4,696,729 | 9/1987 | Santini | 204/224 R |
| 4,828,654 | 5/1989 | Reed | 204/23 |
| 4,861,452 | 8/1989 | Stierman et al. | 204/297 |
| 4,879,007 | 11/1989 | Wong | 204/15 |
| 4,906,346 | 3/1990 | Hadersbeck et al. | 204/238 |
| 4,931,149 | 6/1990 | Stierman et al. | 204/15 |
| 5,000,827 | 3/1991 | Schuster et al. | 204/15 |
| 5,024,746 | 6/1991 | Stierman et al. | 204/297 W |
| 5,078,852 | 1/1992 | Yee et al. | 204/297 R |
| 5,096,550 | 3/1992 | Mayer et al. | 204/129.1 |
| 5,135,636 | 8/1992 | Yee et al. | 205/96 |
| 5,222,310 | 6/1993 | Thompson et al. | 34/202 |
| 5,227,041 | 7/1993 | Brogden et al. | 204/297 R |
| 5,332,487 | 7/1994 | Young, Jr. et al. | 205/80 |
| 5,372,699 | 12/1994 | Rischke et al. | 205/129 |
| 5,377,708 | 1/1995 | Bergman et al. | 134/105 |
| 5,391,285 | 2/1995 | Lytle et al. | 205/123 |
| 5,405,518 | 4/1995 | Hsieh et al. | 204/297 |
| 5,421,987 | 6/1995 | Tzanavaras et al. | 205/133 |
| 5,429,733 | 7/1995 | Ishida | 204/224 R |
| 5,437,777 | 8/1995 | Kishi | 204/224 R |
| 5,441,629 | 8/1995 | Kosaki | 205/148 |
| 5,443,707 | 8/1995 | Mori | 204/242 |
| 5,447,615 | 9/1995 | Ishida | 204/224 R |
| 5,462,649 | 10/1995 | Keeney et al. | 205/93 |
| 5,472,592 | 12/1995 | Lowery | 205/137 |
| 5,498,325 | 3/1996 | Nishimura et al. | 205/96 |
| 5,522,975 | 6/1996 | Andricacos et al. | 204/297 R |
| 5,597,460 | 1/1997 | Reynolds | 204/212 |
| 5,670,034 | 9/1997 | Lowery | 205/143 |
| 5,725,745 | 3/1998 | Ikegaya | 204/284 |
| 5,750,014 | 5/1998 | Stadler et al. | 204/224 |
| 5,788,829 | 8/1998 | Joshi et al. | 205/96 |
| 5,804,052 | 9/1998 | Schneider | 205/96 |
| 5,843,296 | 12/1998 | Greenspan | 205/68 |
| 5,855,850 | 1/1999 | Sittler | 422/98 |

OTHER PUBLICATIONS

IBM Techncial Disclosure Bulletin No. 32 (Jun. 1989) entitled Upside–Down Resist Coating of Semiconductor Wafers (2 pages).

Document entitled "Automated Gold Plate–up Bath Scope Document and Machine Specifications" dated Aug. 4, 1989 by Evan Patton, Dave Hart, Perry & Wayner Fetters.

*Primary Examiner*—Kathryn Gorgos
*Assistant Examiner*—Erica Smith-Hicks
*Attorney, Agent, or Firm*—Skjerven, Morrill, MacPherson, Franklin and Friel

[57] ABSTRACT

An electroplating system includes shield(s) to control the thickness profile of a metal electrodeposited onto a substrate. The shield(s) are positioned between the anode and the cathode in a standard electroplating apparatus with a device for rotating the plating surface. The cathode is rotated so that the shield(s) in conjunction with the rotation of the cathode selectively alters or modulates a time average of the electric field characteristics between the anode and the cathode. The modulated electric field is used to control the electrodeposition rate at selected area(s) of the plating surface of the cathode, thereby causing the metal deposited on the cathode to have a modified thickness profile.

3 Claims, 6 Drawing Sheets

ELECTROPLATING SYSTEM WITH SHIELDS FOR VARYING THICKNESS PROFILE OF DEPOSITED LAYER

FIELD OF THE INVENTION

The present invention relates to electroplating systems and more particularly, to electroplating systems for electroplating semiconductor wafers.

BACKGROUND

In the semiconductor integrated circuit industry, physical vapor deposition techniques (e.g., sputtering, evaporation) and chemical vapor deposition techniques are typically used to deposit metal onto a semiconductor wafer. However, in a recent trend, some semiconductor integrated circuit manufacturers are investigating or using electroplating techniques to deposit metal primary conductor films on semiconductor substrates. In a typical conventional electroplating process for integrated circuit applications, a metal (e.g., copper) is electrodeposited onto a semiconductor wafer. Typically, the copper layer is electrodeposited onto a substrate that has been patterned and etched to define recessed interconnect features using standard photolithographic techniques. The electrodeposited copper layer is then etched back or polished to form conductive interconnect structures.

Generally, in electroplating processes, the thickness profile of the deposited metal is controlled to be as uniform as possible. In many typical integrated circuit applications, it is advantageous for the electrodeposited metal layer to have a uniform or flat thickness profile across the substrate surface to optimize subsequent etchback or polish removal steps.

However, typical conventional electroplating techniques are susceptible to non-uniform thickness profile variations. Non-uniform thickness profiles may result from any number of causes such as the geometric size and shape of the electroplating cell, depletion effects, "hot edge" effects, and the "terminal effect".

For example, the terminal effect arises as follows. In electroplating metals onto a wafer, a conductive seed layer is typically first deposited on the wafer to facilitate electrodeposition of the metal. The seed layer is typically formed using a non-electroplating process (e.g., chemical vapor deposition, physical vapor deposition). The seed layer is needed because the wafer serves as the cathode of the electroplating cell, which requires that the wafer surface be conductive. The seed layer provides this required conductivity. Then, during the electrodeposition process, a potential is applied at the edge of the wafer.

However, because the seed layer is initially very thin, the seed layer has a significant resistance radially from the edge to the center of the wafer. This resistance contributes to a potential drop from the edge (electrical contact point) of the wafer to the center of the wafer. Thus, the potential of the seed layer is initially not uniform (i.e., tends to be more negative at the edge of the wafer) when the potential is applied. Consequently, the initial electrodeposition rate tends to be greater at the edge of the wafer relative to the interior of the wafer. As a result of this initial non-uniform deposition rate, the final electrodeposited metal layer tends to have a concave thickness profile (i.e., thicker at the edges of the wafer and thinner at the center of the wafer).

Generally, whatever the cause, non-uniformities in the final thickness profile of the electrodeposited metal are undesirable. Thus, it may be desirable to control the thickness profile of the electrodeposited metal to compensate for the non-uniformities that can arise in the electroplating process.

In other applications, it may be desirable to control the thickness of the deposited metal over the wafer to have selected non-level profiles. For example, a chemical mechanical polishing (CMP) process may be subsequently performed on the electrodeposited metal layer. Some CMP processes have non-uniform polishing rates at different locations of the wafer. Thus, it may be desirable for the metal layer to have a selected non-uniform thickness profile to compensate for the different polishing rates.

Accordingly, there is a need for an electroplating system capable of selectably controlling the thickness of the electrodeposited metal to a desired profile.

SUMMARY

In accordance with the present invention, an electroplating system capable of controlling the thickness profile of a metal electrodeposited onto a substrate is provided. In one embodiment adapted for metal electrodeposition upon a plating surface, the electroplating system includes a standard electroplating apparatus with a device for rotating the plating surface. In accordance with the present invention, one or more shields are disposed in the electroplating apparatus to selectively alter or modulate the electric field characteristics between the anode and the cathode (the plating surface in this embodiment) of the electroplating apparatus to control or adjust the electrodeposition rate at one or more selected areas of the plating surface.

The shield or shields are disposed between the anode and the cathode. A relative rotational movement is then imparted between the cathode and the one or more shields. As a result of this relative rotation, any given point on the cathode will be coupled to a modulated electric field. In particular, the electric field is modulated so that a desired time-averaged electric field intensity is applied to each given point on the cathode. Because the electrodeposition rate of a particular region depends in part on the characteristics of the electric field, the thickness profile of the electrodeposited metal can be selectively controlled by the shape of the shield or shields. Thus, the shield or shields can be selectively shaped to achieve a final thickness profile that is flat, compensating for any non-uniform thickness profile that would be observed in the electroplated wafers without such shield or shields.

DETAILED DESCRIPTION

Figure 1:
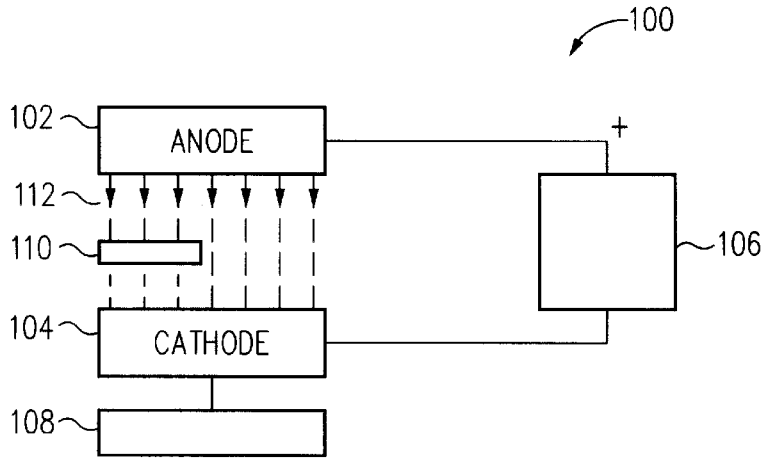
FIG. 1 is a functional block diagram of an electroplating system according to one embodiment of the present invention.

FIG. 1 is a functional block diagram of an electroplating system 100 according to one embodiment of the present invention. The electroplating system 100 includes an anode 102, a cathode 104, a voltage source 106, and a rotator 108. In addition, the electroplating system 100 includes a shield 110 in accordance with the present invention.

This embodiment of the electroplating system 100 is adapted for integrated circuit fabrication and, more particularly, for electroplating semiconductor wafers with copper. Thus, the anode 102 is a disk of copper metal and the cathode is a semiconductor wafer having a conductive plating surface. Of course, in other embodiments, a metal other than copper may be electrodeposited.

In this particular embodiment, the electroplating system 100 is in a close-coupled configuration. More specifically for this close-coupled embodiment, the anode 102 and the cathode 104 have substantially the same diameter and are relatively disposed in an electrolytic solution so that the anode 102 and the cathode 104 are parallel and are separated by about a half-inch to about four inches. In addition, the anode 102 and cathode 104 are aligned coaxially. Although a close-coupled configuration is described, other embodiments may be implemented such as, for example, remote anode or virtual anode configurations. Further, in other embodiments, the size and shape of the anode may be different and need not be similar to the size and shape of the cathode.

A voltage source 106 is connected to the anode 102 and the cathode 104 to set up an electric field between the anode 102 and the cathode 104, as indicated by arrows 112. The rotator 108 rotates the cathode 104. The anode 102, cathode 104, voltage source 106 and rotator 108 can be implemented with an electroplating apparatus as disclosed in Patton et al., co-filed U.S. patent application Ser. No. 08/969,984, filed Nov. 13, 1997, pending which is incorporated by reference herein.

Alternatively, a standard electroplating apparatus can be used such as, for example, a model LT210 available from Semitool, Kalispell, Mont. Of course, any suitable commercially available or custom electroplating apparatus with a mechanism for rotating the plating surface can be used in other embodiments.

In accordance with the present invention, the shield 110 is disposed between the anode 102 and the cathode 104 to selectively vary or modulate the time-averaged intensity of the electric field 112 between the anode 102 and the cathode 104. In this embodiment, the shield 110 is located about a half-inch from the cathode 104, but the position of the shield 10 can range from resting on the anode 102 to about slightly separated from the cathode 104.

The shield 110 is preferably made of a non-conductive material that is resistant to the acid bath typically used in copper electroplating processes. For example, the shield 110 can be made of polyethylene, polypropylene, fluoropolymers (e.g., Teflon® or polyvinylidene fluoride (PVDF). A mechanical bracket or collar can be used to position the shield 110 in the electroplating cell as desired. Thus, the shield 110 can be easily removed or modified as required and, further, can be easily retrofitted to existing electroplating apparatus.

The shield 110 is shaped so that, in conjunction with the rotation of the cathode 104 and the shield's location between the anode 102 and the cathode 104, the time-averaged electric field present between the anode 102 and a particular point on the cathode plating surface is controlled to a desired level. By controlling the characteristics of the electric field present between the anode 102 and specific points on the plating surface of the cathode 104, the local charge transfer rate at these specific points is advantageously controlled (i.e., the local charge transfer rate is related to the electric field between the anode and the local point on the cathode). Further, the local electrodeposition rate is related to the local charge transfer rate; thus, controlling the electric field can be used to control the local electrodeposition rate and thereby the thickness profile of the electrodeposited metal across the plating surface of the cathode 104.

In an alternative embodiment, the electroplating system 100 may include a second rotator (not shown) for rotating the shield 110. The second rotator preferably rotates the shield 110 differently in angular rate or direction from the rotation of the cathode 104. For example, the shield 110 may be rotated significantly slower than the cathode 104 or in the opposite direction. Rotating the shield 110 serves to even out the erosion across the surface of the anode 102.

Figure 2:
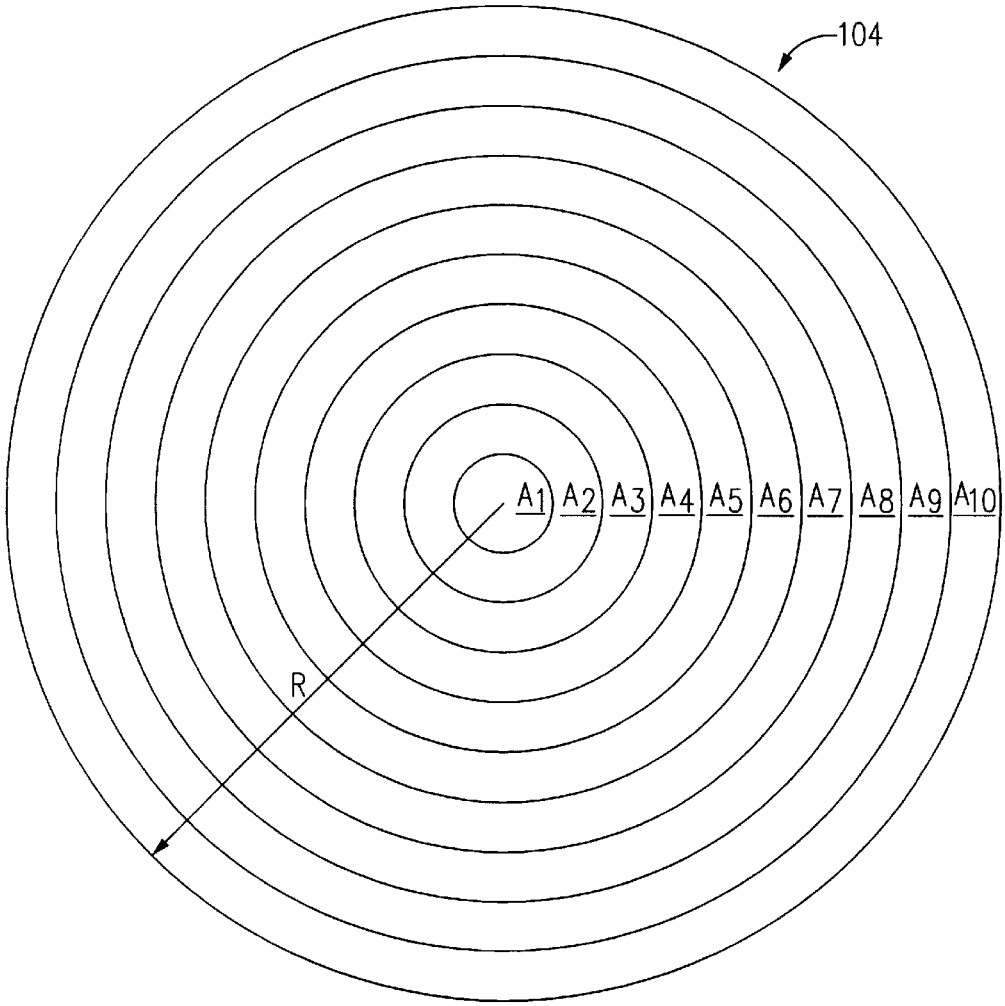
FIG. 2 is a view of a circular cathode with concentric annular regions indicated thereon, according to one embodiment of the present invention.

FIG. 2 is a view of the surface of the cathode 104 that faces the anode 102 (FIG. 1). In this embodiment, the cathode 104 is shown with concentric annular regions $A_1$–$A_{10}$ indicated thereon. As described further below in conjunction with FIGS. 3–10, these annular regions are used in helping to determine the general effect a shield is expected to have on the thickness profile of the electrodeposited metal. In this embodiment, the cathode 104 is a six-inch radius semiconductor wafer, with the annular regions $A_1$–$A_{10}$ having 0.6 inch widths.

Figure 3:
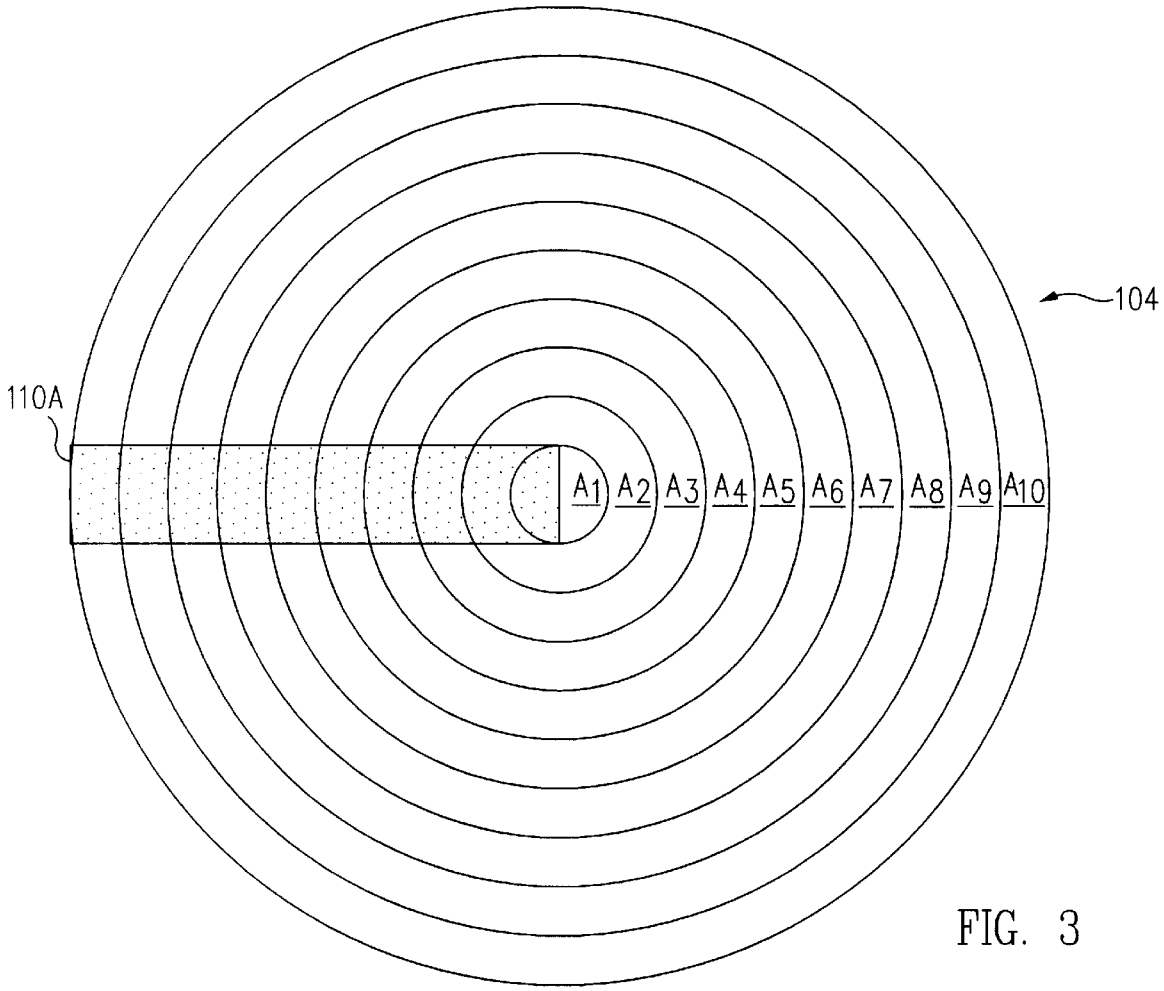
FIG. 3 is a view of the cathode of FIG. 2 masked with a rectangular shield, according to one embodiment of the present invention.

FIG. 3 is a view of the surface of the cathode 104 facing the anode 102 (FIG. 1) masked with a rectangular shield 110A, according to one embodiment of the present invention. The rectangular shield 110A is about six inches long and about 1.2 inches wide. One end of the rectangular shield 110A is aligned with the center of the cathode 104. The other end of the rectangular shield 110A is aligned with the edge of the cathode 104. In this embodiment, the rectangular shield 110A is mounted between the cathode 104 and the anode 102. More specifically, the shield 110A is used to mask portions of the surface of the cathode 104 (FIG. 1).

Referring to FIGS. 1 and 3, the electroplating system 100 operates as follows. The cathode 104 is rotated by the rotator 108 at a rate of about one hundred revolutions per minute (rpm), but the rotation rate can range from about twenty rpm to about two hundred rpm. In this embodiment, the shield 110 (FIG. 1) is implemented with the rectangular shield 110A (FIG. 3). Because the shield 110A is made of non-conductive material, the portion of the electric field 112 between the anode 102 and the cathode 104 through the shield 110A is altered. Further, because the cathode 104 is rotated, regions of the cathode 104 see a relative decrease (when considered on a time-averaged basis) in the applied or coupled electric field as a function of the radial distance from the center of the cathode 104. More specifically, this relative decrease is taken with reference to the applied time-averaged electric field that a particular region of the cathode 104 would see if the shield 110A were not in place. Thus, in effect, a particular point on the surface of the cathode 104 will experience, on a time-averaged basis, a varying intensity electric field that is determined in part by the size and shape of the shield 110 (FIG. 1).

For illustrative purposes, the annular regions $A_1$–$A_{10}$ on the cathode 104 are used below to describe the effect of the varying intensity electric field on the electrodeposition process. Of course, in actual practice, the electrodeposition process is continuous with respect to the radial distance from the center of the wafer (cathode 104).

As is well known in the art of electrodeposition, the local charge transfer rate on the plating surface is related to the strength and shape of the electric field in the region between anode and the local point on the cathode. However, in the electroplating system 100, portions of the cathode 104 are masked by the shield 110, which affects the electric field as described above. Thus, for a given time duration, the charge transfer rate of metal ions to a specific annular region of the plating surface of the cathode 104 is related to the normalized unmasked surface area of that specific annular region of the cathode 104. As used herein, the normalized unmasked surface area is defined as the ratio of the unmasked surface area of an annular region of the cathode 104 to the total surface area of that same annular region of the cathode 104. Thus, the normalized unmasked surface area will range between one and zero.

Further, it is expected that the annular regions of the cathode 104 having a relatively high normalized unmasked surface area will experience a relatively higher charge transfer rate. Because the electrodeposition rate is related to the charge transfer rate, the electrodeposition rate at a particular annular region of the cathode 104 is expected to be relatively higher for annular regions having a relatively high normalized unmasked surface area. Therefore, the electrodeposition rate (and thus the thickness profile of the electrodeposited metal) can be controlled by appropriately shaping the shield 110 (FIG. 1).

Figure 4:
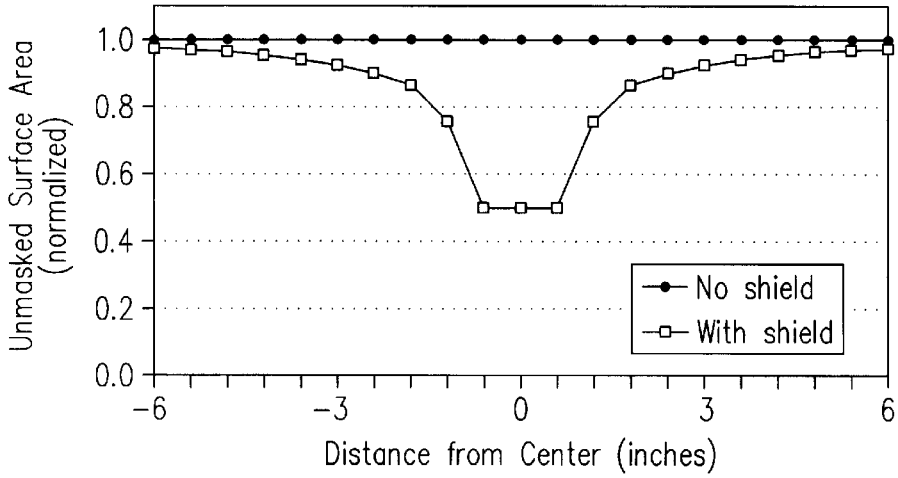
FIG. 4 is a chart showing the normalized unmasked surface area of the cathode as a function of radial distance, resulting from the shield of FIG. 3.

FIG. 4 shows a chart of the normalized unmasked surface area of the cathode 104 (resulting from the shield 110A in FIG. 3) as a function of the distance from the center of the cathode 104. As described above in conjunction with FIG. 3, the electric field strength aligned with each of the annular regions $A_1$–$A_{10}$ is believed to be related to the normalized unmasked surface area of each annular region. Because the charge transfer rate is related to the electric field strength, the chart of FIG. 4 is indicative of the charge transfer rate for each annular region. Further, because the electrodeposition rate is directly related to the charge transfer rate, the chart of FIG. 4 is also indicative of the general thickness profile effect the shield will have on the electrodeposited metal. Of course, the actual thickness profile of the electrodeposited metal will depend on the various parameters used in the electroplating process (e.g., the metal used, the voltage and current applied, the concentration, temperature, flow and type of the additives and components in the electroplating bath). Accordingly, an iterative or trial-and-error method can be used to tune the shield to achieve the desired thickness profile.

In this embodiment, because the masked area of each annular region is roughly similar while the total area of the annular regions significantly increases as the annular regions are further from the center of the cathode 104, the normalized unmasked surface area is relatively high at the center of the cathode 104 and decreases with increasing distance from the center of the cathode 104. Accordingly, the rectangular shield 110A is expected to cause the electrodeposited metal to have a roughly "V"-shaped thickness profile across the cathode diameter (i.e., wafer). The number of annular regions can be increased to increase resolution for more accurate prediction of the thickness profile of the electrodeposited metal.

Although a single rectangular shield is described to achieve this normalized unmasked surface area profile, in other embodiments the shield may be divided into several shields or "sub shields", achieving substantially similar results. For example, the rectangular shield 110A may be cut into four 0.3-inch-by-six-inch rectangular shields. These smaller shields can then be placed at different radial locations between the anode and cathode. These smaller shields together achieve substantially the same normalized unmasked surface area profile shown in FIG. 4.

FIGS. 5–10 illustrate further examples of shield shapes. As described above for the shield 110A (FIG. 3), the shield shapes described below in FIGS. 5–10 may also be divided into two or more smaller shields and placed in appropriate positions to achieve substantially identical normalized unmasked surface areas. Moreover, any number, size and shape of shield or shields may be used to achieve a desired normalized unmasked surface area (and thereby the desired thickness profile of the electrodeposited metal).

Figure 5:
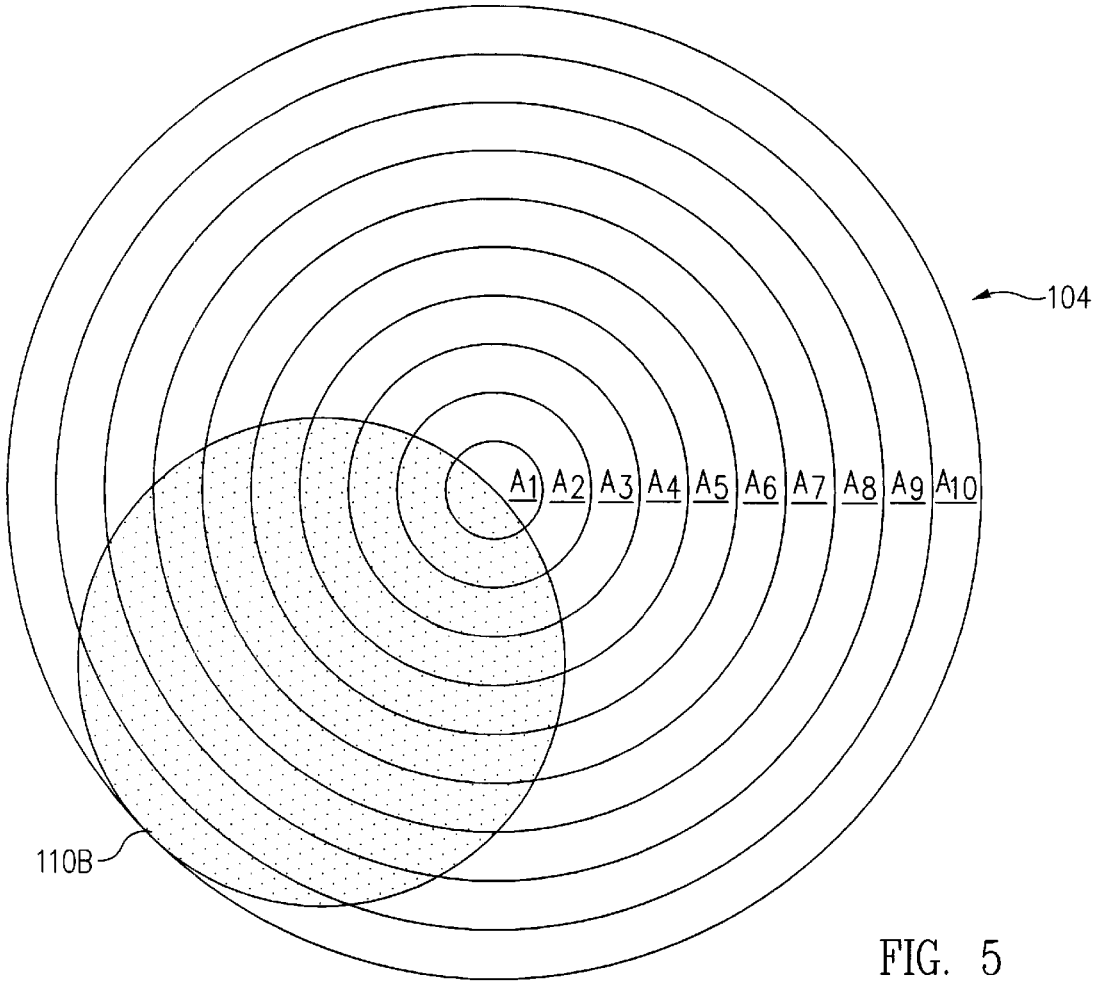
FIG. 5 is a view of a cathode masked with a circular shield, according to another embodiment of the present invention.
Figure 6:
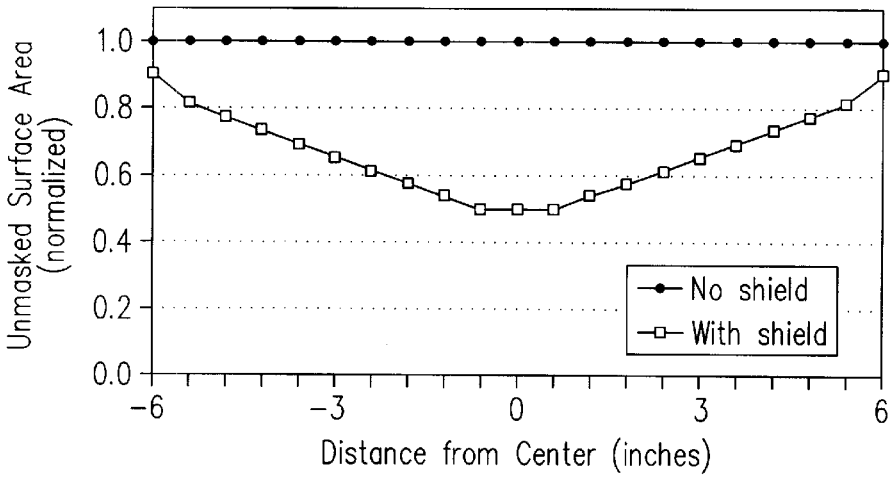
FIG. 6 is a chart showing the normalized unmasked surface area of the cathode as a function of radial distance, resulting from the shield of FIG. 5.

FIG. 5 is a view of the cathode 104 masked with a circular shield 110B, according to another embodiment of the present invention. In this embodiment, the shield 110B is about six inches in diameter and disposed so that one end of a diameter of the shield 110B is aligned with the center of the cathode 104 while the other end of the diameter is aligned with the edge of the cathode 104. Otherwise, the shield 110B is used in substantially the same manner as the shield 110A (FIG. 3). FIG. 6 is a chart of the normalized unmasked surface area of the cathode 104 (resulting from the shield 110B in FIG. 5) as a function of the radial distance from the center of the cathode 104. As shown in FIG. 6, the normalized unmasked surface area of the cathode 104 gradually increases as the distance from the center of the cathode 104 increases. Thus, the thickness profile resulting from the use of the shield 110B is expected to be a relatively smooth concave profile across the cathode diameter. To obtain more gradual contours, the shield 110B can be modified into, for example, elliptical shapes of various eccentricity.

Figure 7:
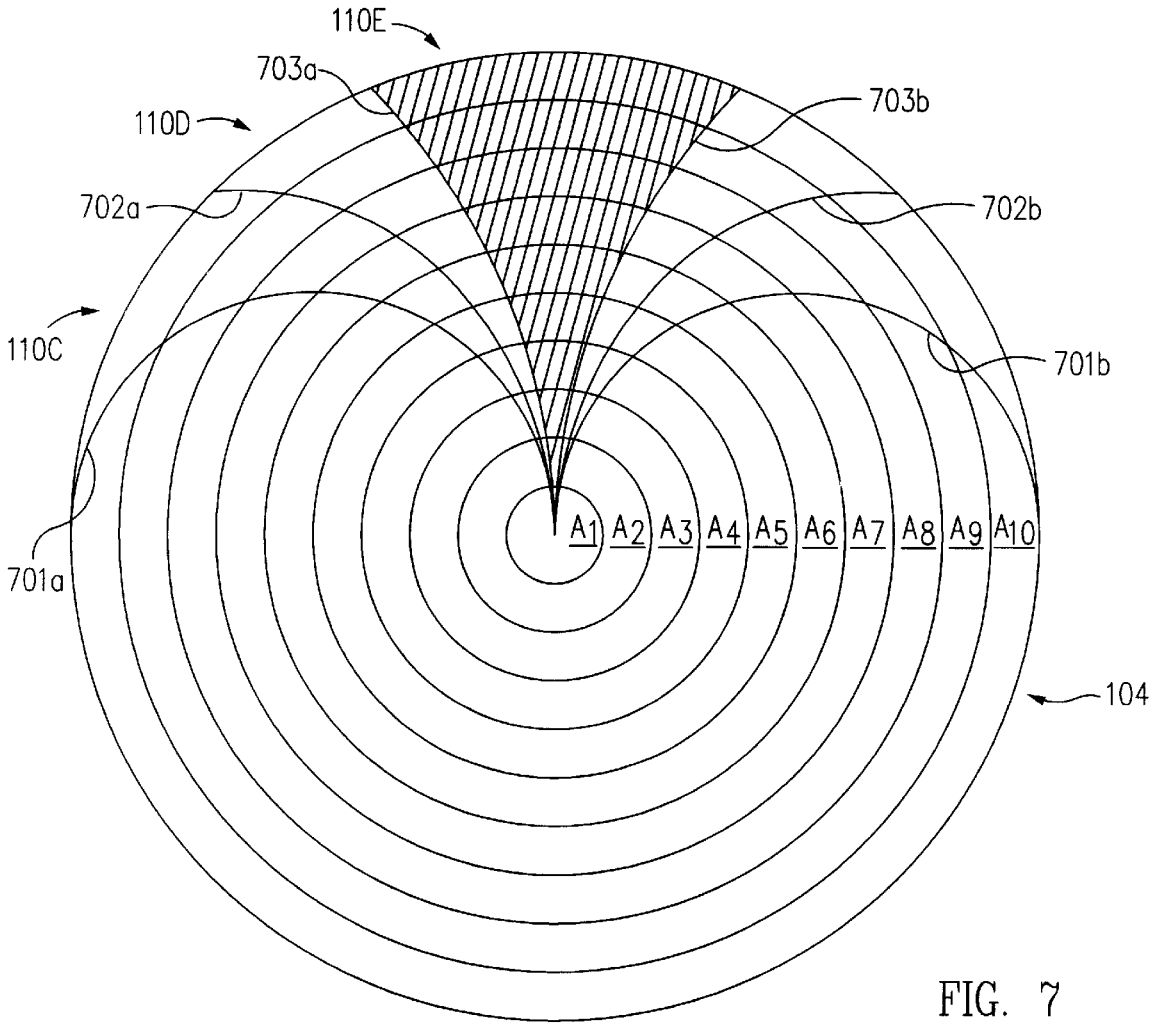
FIG. 7 is a view of a cathode masked with arc shields with curved sides, according to other embodiments of the present invention.

FIG. 7 is a view of the cathode 104 masked with a shields 110C–110E respectively having pairs of curved sides 701*a*, 701*b*, 702*a*, 702*b*, 703*a* and 703*b* extending from the center of the cathode 104 to the edges of the cathode 104. The curved sides 701*a* and 701*b* of the shield 110C have a radius of curvature of about six inches. The curved sides 701*a* and 701*b* each has an inner end that is aligned with the center of the cathode 104. The outer ends of the curved sides 701*a* and 701*b* are aligned with the edge of the cathode 104. The line connecting the inner end and the outer end of the curved side 701*a* and the line connecting to the inner end and the outer end of the curved side 701*b* side form an angle of about 180°.

The curved sides 702*a* and 702*b* of the shield 110D have a radius of curvature of about 8.4 inches. The curved sides 702*a* and 702*b* have inner and outer ends similar to the inner and center ends of curved sides 701, except that the lines connecting the inner end and the outer end of each curved side form an angle that contains the shield 110D of about 90°. The curved sides 703*a* and 703*b* of the shield 110E have a radius of curvature of about 14.4 inches. Similarly, for the curved sides 703*a* and 703*b*, the lines connecting the inner end and the outer end of each curved side form an angle that contains the shield 110E of about 60°. Shields having this type of shape are referred to herein as arc shields with curved sides.

Figure 8:
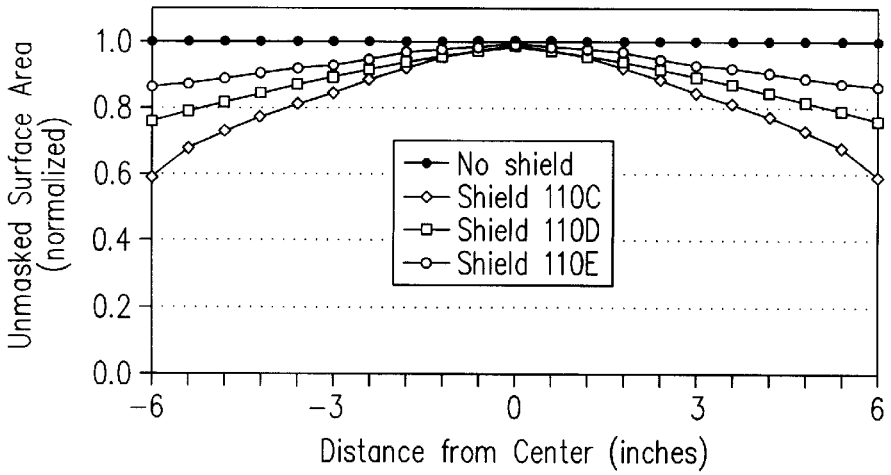
FIG. 8 is a chart showing the normalized unmasked surface area of the cathode as a function of radial distance, resulting from the shield(s) of FIG. 7.

FIG. 8 is a chart of the normalized unmasked surface area of the cathode 104 (resulting from shields 110C–110E in FIG. 7) as a function of the distance from the center of the cathode 104. As shown in FIG. 8, the normalized unmasked surface area of the cathode 104 gradually decreases as the distance from the center of the cathode 104 increases. Thus, the thickness profiles resulting from the use of the shields 110C–110E are expected to be relatively smooth convex profiles, with the thickness profile being more curved as the radius of curvature of the shield's curved edges decreases. Because of the resulting convex thickness profile, arc shields with curved edges can be advantageously used to compensate for electroplating processes or apparatus that undesirably produce thickness profiles that are thicker at the edges of the wafer (e.g., the aforementioned terminal effect).

Figure 9:
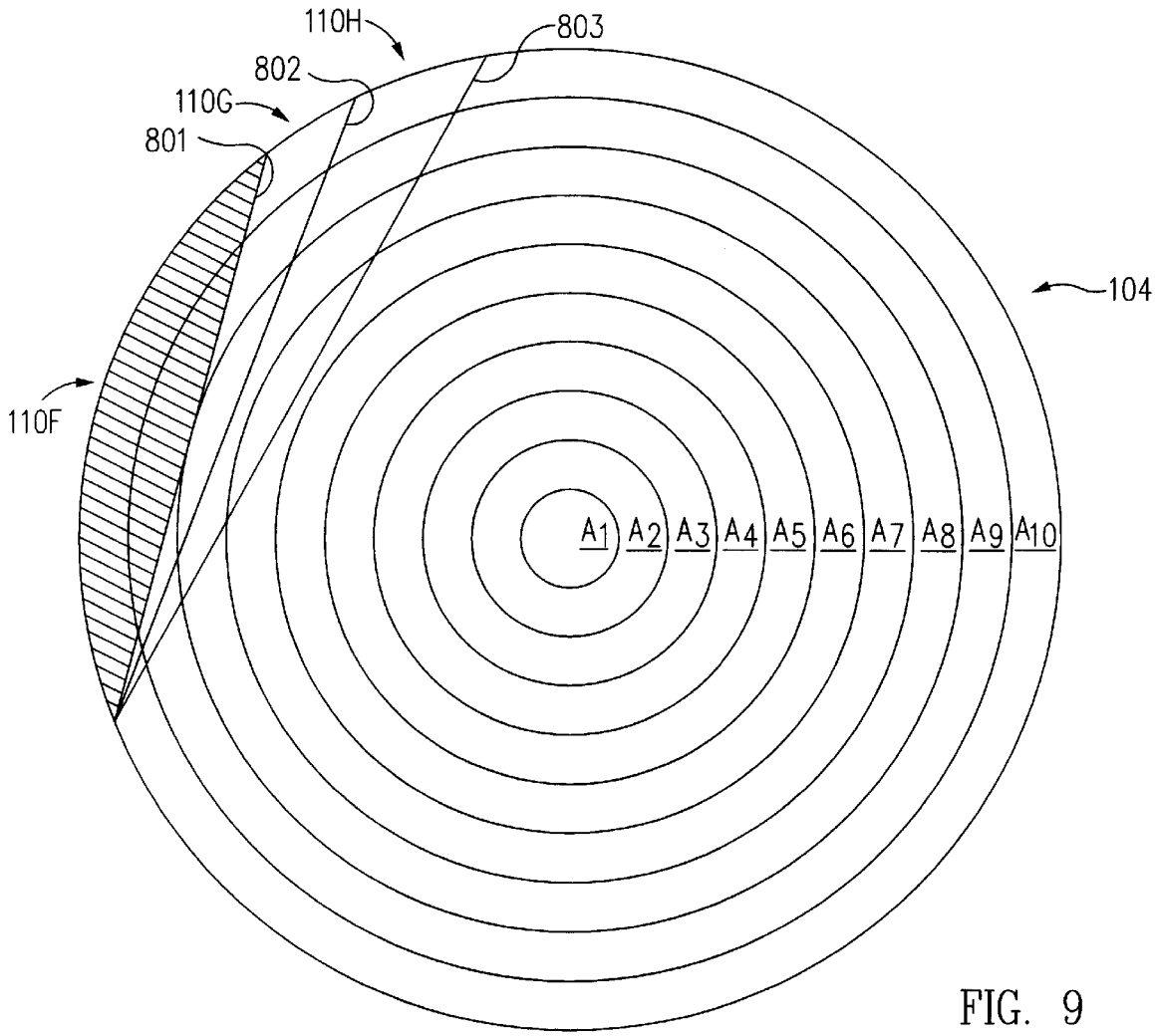
FIG. 9 is a view of a cathode masked with arc shields with straight sides, according to other embodiments of the present invention.

FIG. 9 is a view of the cathode 104 masked with a shields 110F–110H respectively having straight edges 801–803 along three chords of the cathode 104. The straight edges 801–803 are respectively about 7.2 inches, 8.4 inches and 9.6 inches in length. Shields having this type of shape are referred to herein as straight arc shields.

Figure 10:
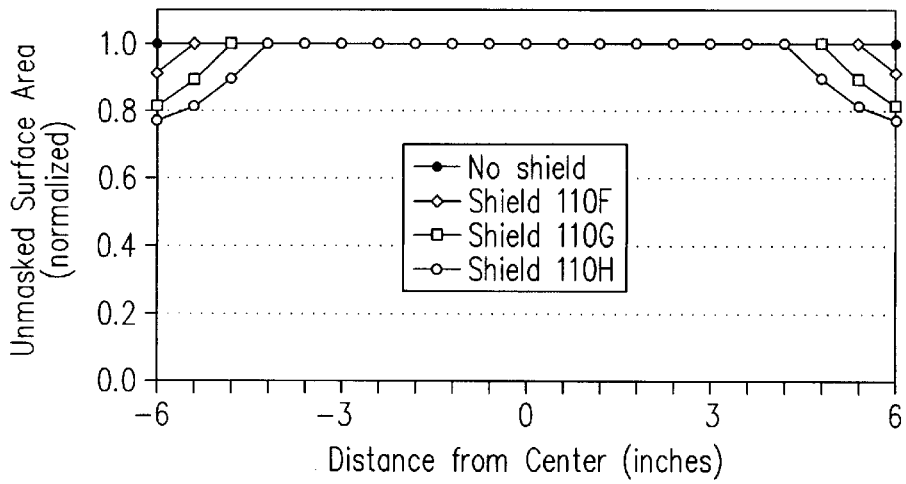
FIG. 10 is a chart showing the normalized unmasked surface area of the cathode as a function of radial distance, resulting from the shield(s) of FIG. 9.

FIG. 10 is a chart of the normalized unmasked surface area of the cathode 104 (resulting from shields 110F–110H in FIG. 9) as a function of the distance from the center of the cathode 104. As shown in FIG. 10, the normalized unmasked surface area of the cathode 104 is at a substantially constant maximum value (i.e., a value of one) until, as the distance from the center of the cathode 104 increases to the nearest point of the straight arc shield, the normalized unmasked surface area begins to drop off relatively quickly. Thus, the thickness profile resulting from the use of the shields 110F–110H is expected to be relatively level in the center portion of the cathode with the thickness as the edges of the cathode 104 decreasing at a relatively high rate. The width of the level central portion is expected to increase as the length of the chord of the straight arc shield decreases. Straight arc shields can also be used to compensate for electroplating processes or apparatus that produce thickness profiles that are thicker at the edges of the wafer.

Although shields of several different shapes are described, those skilled in the art of electroplating appreciate that other shield shapes and configurations can be used to achieve the same or other thickness profiles. In particular, because the thickness of the metal electrodeposited on an annular region on the cathode is expected to be dependent on the normalized unmasked surface area of that annular region of the cathode, any shape or combination of shaped shields can be used to achieve a particular thickness profile. Thus, for example, other embodiments can use a shield large enough to mask the majority of the surface of the cathode, with openings (cutouts) or perforations appropriately located in the shield to achieve the desired normalized unmasked surface area for each annular region.

For example, for these "perforated" embodiments, holes with substantially the same diameter can be distributed across a circular shield with a density that varies with radial distance from the center of the shield. In particular, the density of holes can be controlled to achieve essentially any desired normalized unmasked surface area. Alternatively, the size and shape of the holes can be varied to achieve a desired normalized unmasked surface area. Of course, any combination of hole size, shape, density can be used to achieve the desired normalized unmasked surface area.

Figure 11:
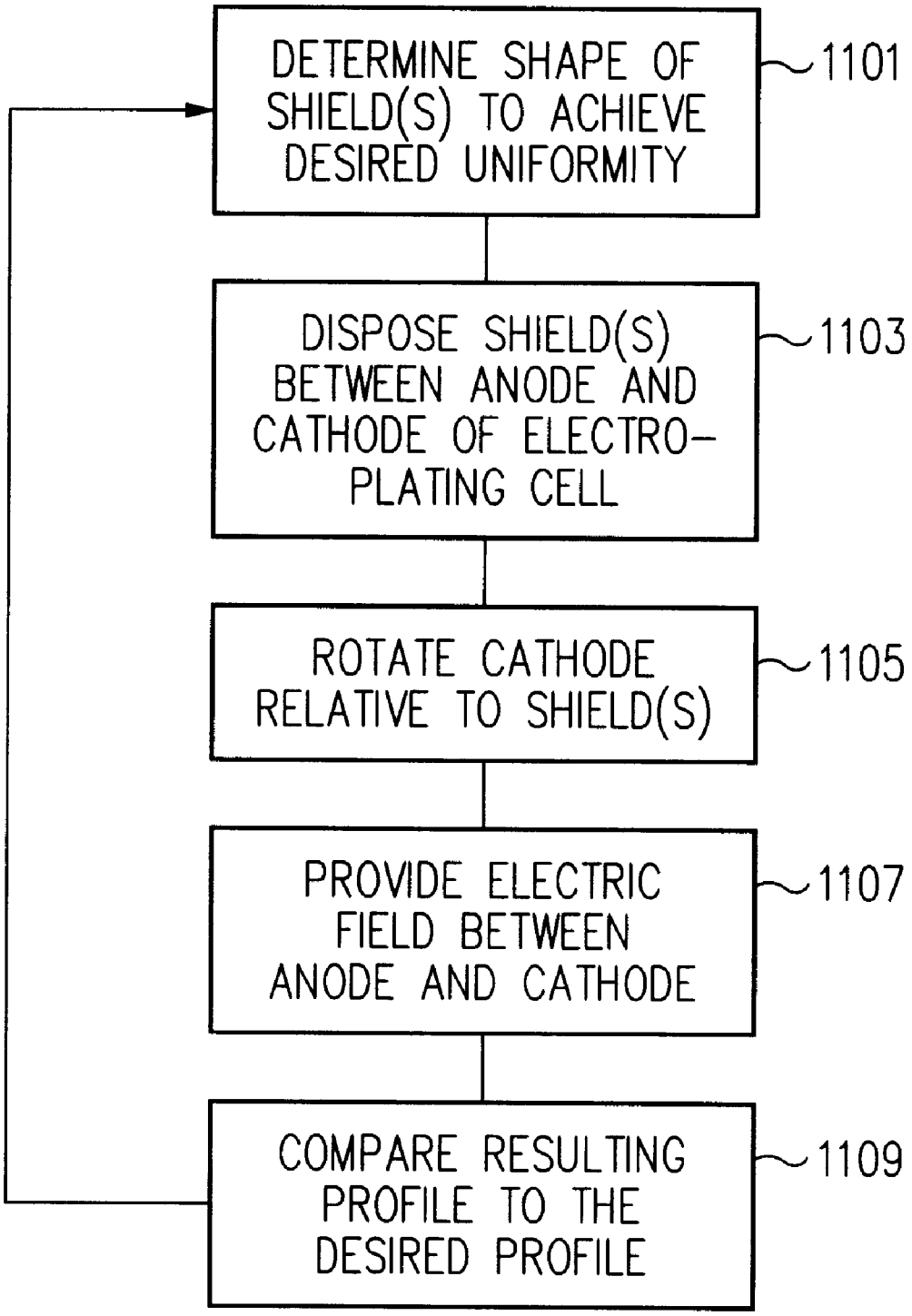
FIG. 11 is a flow diagram illustrative of the operation of the electroplating system according to one embodiment of the present invention.

FIG. 11 is a flow diagram illustrative of the configuration and operation of the electroplating system 100 (FIG. 1) according to one embodiment of the present invention. Referring to FIGS. 1 and 11, the electroplating system 100 is used as follows. In a step 1101, the shape or configuration of the shield 110 is determined. Thus, for example, for a particular set of wafer cathodes and plating apparatus, the desired resultant thickness profile of the electrodeposited metal can be used to predict the normalized unmasked surface area suitable to achieve this desired thickness profile. Then an appropriate shield shape or perforation pattern can be generated using commercially available automated design tools (e.g., AutoCAD® or Pro-E®) to achieve the desired normalized unmasked surface area.

In a subsequent step 1103, the shield 110 is then disposed in the standard electroplating apparatus, between the anode 102 and the cathode 104. Then in a subsequent step 1105, the rotator 108 rotates the cathode 104.

Then in a subsequent step 1107, the voltage source 106 generates a potential between the anode 102 and the cathode 104, causing an electric field to be present between the anode 102 and the cathode 104. As described above, the rotation of the cathode 104 and the position of the shield 110 alters the time-averaged intensity of the electric field between the anode 102 and any given point on the cathode 104. In general, depending on the composition of the shield 110, the shield 110 is expected to substantially reduce the instantaneous electric field strength in the region between the shield and the cathode 104. The shield 110 can reduce the instantaneous electric filed strength to insignificant levels in configurations in which the shield 110 is very near the cathode 104. As a result, the charge transfer rate to the region on the cathode 104 masked by the shield 110 is substantially reduced or even, in effect, eliminated. Because the cathode is rotating, on a time-averaged basis, annular regions on the cathode 102 experience a varying electrodeposition rate. In this manner, the electrodeposition rate can be controlled to achieve the desired thickness profile.

In an optional step 1109, the resulting thickness profile of the electrodeposited metal can be compared to the desired thickness profile. The difference in the thickness profiles (if any) can be used to modify the shape of the shield in an iterative process to more closely achieve the desired thickness profile. After comparing the resulting thickness profile to the desired thickness profile, the process can then return to step 1101 in which the comparison data can be used to modify the shape of the shield.

The embodiments of the electroplating system described above are illustrative of the principles of this invention and are not intended to limit the invention to the particular embodiments described. For example, the shield can be rotated in other embodiments instead of the cathode to achieve the relative rotational relationship between the shield and cathode. In other embodiments, more than one shield may be used to achieve the desired thickness profile. In addition, other embodiments may use for electroplating metals other than copper or different types of electroplating cells (e.g., remote anode or virtual anode cells). In other embodiments, anodes of different sizes, shapes, or configurations may be used instead of the circular anode described. Accordingly, while the preferred embodiment of the invention has been illustrated and described, it is appreciated that in light of the present disclosure various changes can be made to the described embodiments without departing from the spirit and scope of the invention.

I claim:

1. A method of electroplating a metal onto a surface of a substrate, the method comprising:

providing an anode containing said metal;

positioning a shield between said anode and said substrate, immersing said anode, said shield and said substrate in an electrolytic solution, applying a voltage between said anode and said substrate; and rotating said shield about an axis of rotation, said axis of rotation intersecting said surface at a centerpoint;

wherein said shield is shaped such that a first point on said surface located at a first distance from said centerpoint is masked by said shield for a different percentage of the time as compared with a second point on said surface located at a second distance from said centerpoint and wherein essentially no point on said surface is completely masked.

2. A method of electroplating a metal onto a surface of a substrate, the method comprising:

providing an anode containing said metal;

positioning a shield between said anode and said substrate;

immersing said anode, said shield and said substrate in an electrolytic solution;

applying a voltage between said anode and said substrate; and rotating said substrate about a center of rotation;

wherein said shield is shaped such that a first point on said surface located at a first distance from said center of rotation is masked by said shield for a different percentage of the time as compared with a second point on said surface located at a second distance from said center of rotation and wherein essentially no point on said surface is completely masked.

3. An apparatus for depositing a metal onto a surface of a substrate, the apparatus comprising:

a bath container filled with a solution containing ions of the metal to be deposited, the surface disposed so as to contact the solution, wherein the surface is configured to serve as a cathode;

an anode disposed so as to contact the solution;

a shield disposed between the anode and the surface, the surface comprising annular regions concentric with respect to a center of the surface, the shield configured to mask a portion of the surface such that for all annular regions, the ratio of the unmasked surface area of the annular region to the masked surface area of the annular region is greater than zero;

a rotator configured to impart a relative rotation between the surface and the shield; and a power source coupled to the anode and the surface, wherein the power source causes an electric field to be present between the anode and the surface, whereby, responsive to the electric field, ions of the metal are deposited onto the surface, wherein the shield in conjunction with the relative rotation between the shield and the surface is configured to selectively modulate the electric field so as to achieve a time-average of the intensity of the electric field relative to a specific point on the surface.

* * * * *